US005381861A

United States Patent [19]

Crafton et al.

[11] Patent Number: 5,381,861

[45] Date of Patent: Jan. 17, 1995

[54] DRIVE HEAD FOR FLEXIBLE CONVEYOR FLUID LIFTING SYSTEM

[75] Inventors: James W. Crafton, Evergreen; Ronald J. Stene, Littleton; Thomas Shilling; William J. Roper, both of Englewood, all of Colo.

[73] Assignee: SOCO Technologies, Inc., Fort Worth, Tex.

[21] Appl. No.: 192,879

[22] Filed: Feb. 7, 1994

[51] Int. Cl.[6] ..... E21B 43/00

[52] U.S. Cl. ..... 166/77; 198/643

[58] Field of Search ..... 166/105, 75.1, 77, 77.5, 166/78, 79; 198/643

[56] References Cited

U.S. PATENT DOCUMENTS

| | | | |
|---|---|---|---|
| 831,448 | 9/1906 | Leinweber | 198/643 X |
| 930,465 | 8/1909 | Fowler | 198/643 |
| 1,017,847 | 2/1912 | Carl | 198/643 |
| 1,703,963 | 3/1912 | Scruby | 198/643 |
| 1,740,821 | 12/1929 | Kneuper | 198/643 |
| 1,763,395 | 6/1930 | Frederick | 198/643 |
| 1,799,086 | 3/1931 | Caretta . | |
| 2,121,931 | 6/1938 | Sloan | 198/643 |
| 2,289,706 | 7/1942 | Hay | 198/643 |
| 2,329,913 | 9/1943 | Bohannon | 198/643 |
| 2,380,144 | 7/1945 | Bohannon | 198/643 |
| 2,704,981 | 3/1955 | Gustafson | 198/643 |
| 3,774,685 | 11/1973 | Rhodes | 198/643 |
| 4,146,477 | 3/1979 | Challenges | 210/924 |
| 4,265,304 | 5/1981 | Baugh | 166/77 |
| 4,585,061 | 4/1986 | Lyons, Jr. et al. | 166/77 |
| 4,652,372 | 3/1987 | Threadgill | 210/924 |
| 4,712,667 | 12/1987 | Jackson et al. | 198/643 |
| 4,743,175 | 5/1988 | Gilmore | 166/77 X |
| 4,832,182 | 5/1959 | Wallace, Jr. | 198/833 X |
| 4,962,847 | 10/1990 | Pisors et al. | 198/643 |
| 5,048,670 | 9/1991 | Crafton et al. . | |
| 5,080,781 | 1/1992 | Evins, IV | 210/112 |

FOREIGN PATENT DOCUMENTS

| | | | |
|---|---|---|---|
| 2475155 | 8/1981 | France | 198/643 |
| 58-193806 | 11/1983 | Japan | 198/643 |
| 128719 | 6/1919 | United Kingdom . | |
| 928067 | 5/1982 | U.S.S.R. | 198/643 |
| 939341 | 6/1982 | U.S.S.R. . | |
| 953261 | 8/1982 | U.S.S.R. | 198/643 |

*Primary Examiner*—Michael Powell Buiz
*Attorney, Agent, or Firm*—Jefferson Perkins

[57] ABSTRACT

An improved drive head for use in transporting materials has a frame for mounting near a tubing orifice, a drive wheel and second wheel rotatably mounted on the frame. Each of the wheels are adaptable to receive a fluid entraining conveyor. The drive head causes the conveyor to move through a predetermined conveyor path on which the conveyor winds about the drive wheel through at least a majority of its surface, and preferably 330°. The radius of a down-conveyor conveyor track of the second wheel is preferably slightly greater than the radius of the drive wheel conveyor track. Preferably, tires are provided which are mounted on wheel hubs of the drive and second wheels, and these tires may be made of an elastomer having a higher coefficient of friction than the preferably plastic drive and second wheel hubs. The preferred embodiment includes a third wheel which is disposed on the conveyor path to be closer to the orifice than the second wheel.

47 Claims, 5 Drawing Sheets

DRIVE HEAD FOR FLEXIBLE CONVEYOR FLUID LIFTING SYSTEM

TECHNICAL FIELD OF THE INVENTION

This invention relates in general to well production apparatus, and more particularly to drive heads for well production rope conveyors.

BACKGROUND OF THE INVENTION

There currently exist many low production, or "stripper", oil wells in the United States and elsewhere in the world. The oil in these wells is not under the tremendous gas pressure commonly found in wells in new fields, and thus the oil must be lifted out of the well. The standard method for transporting oil from these wells is to use the "horse's head" or sucker rod pump commonly seen in oil fields in this country (see FIG. 1).

This type of pump is expensive to manufacture, install and maintain. A typical used pump assembly of this type can easily cost US $30,000.00. Additionally, this type of pump requires a large well servicing truck and rig for installation and for repairing problems in the down-hole portion of the pump assembly and in the tubing string. A typical well servicing vehicle costs, at the time of writing, approximately US $650,000.00 and weighs over 120,000 pounds. To service a conventional stripper well workers must erect a derrick that typically extends from 50 to 125 feet in the air and that is capable of lifting approximately three hundred and fifty thousand pounds of conventional steel tubing string. The installation and servicing of such pumps and tubing is both a costly and time consuming task.

It is generally known to those skilled in the art that conveyor ropes, belts, bands, strands, etc. (collectively hereinafter, "conveyors") can be caused to move along a predetermined path to convey materials. However, many of these devices suffer from a difficulty in maintaining the conveyor or belt at a sufficient and consistent speed to allow the effective transportation of materials. A "drive head" or "drive apparatus" for these conveyors is a mechanical or other means for exerting force on the conveyor, and ideally propels the conveyor through the system at a sufficient and consistent velocity. The drive apparatus in these prior systems often allow the conveyor or rope to slip as it is being propelled. This slippage causes additional wear and tear on the conveyor, causing costly delays while the transport mechanism is serviced to repair or replace broken or badly frayed conveyors.

Previous conveyor drive heads permit the conveyor to physically be lifted off the drive wheel(s) in the drive head due to centrifugal force, and in the case of systems transporting fluids, by hydroplaning due to the lubrication provided by such fluids, thereby causing the tractive effort to be insufficient to move the conveyor, and often resulting in its being abraded to failure. Certain prior art drive heads use one or more counterpoised wheels or belts to exert force by pinching the conveyor, either linearly or in a radial fashion, to induce traction, but these structures experience rapid wear of the conveyor due to internal abrasion. Further, all of these methods appear to be susceptible to "stalling" during which the conveyor speed drops to zero when the exit side tension drops to zero. Additionally, such many prior art drive heads suffer from being mechanically complex.

Heretofore, there has been no reliable and dependable mechanism for driving a conveyor along a predetermined path with relatively little slippage such that the conveyor consistently travels at a sufficient speed to transport materials dependably, has sufficient traction to draw the rope and fluids entrained therewith to the surface, exhibits a reduced rate of wear, and is mechanically simple.

SUMMARY OF THE INVENTION

The present invention relates to a drive head adaptable to propel a conveyor (herein defined to include, without limitation, ropes, strings, bands, filaments, cables, strands, and belting) through a predefined conveyor path such that the conveyor is capable of transporting fluid materials. The drive head of the invention includes at least a drive wheel and a second wheel rotatably mounted on a frame. Each wheel is adaptable to receive a fluid entraining conveyor and each is adjacent a conveyor path. The drive wheel has a first conveyor track with a predetermined radius; the conveyor path is such that the conveyor comes into contact with at least a majority of the circumference of the first conveyor track. The second wheel has a second conveyor track with a radius larger than the radius of the first conveyor track. This second conveyor track is intentionally oversized so as to take any slack out of the conveyor and keep the conveyor tightly cinched to the drive wheel. A prime mover imparts a rotational force to the drive wheel.

According to another aspect of the invention, the drive head forms a portion of a system for transporting fluids wherein the drive head is adaptable to receive an endless fluid-entraining conveyor, and causes the endless rope to move about the conveyor path. The conveyor circulates into a tubing orifice (such as a well head), proceeds down the tubing to a remote pulley, and then returns to the drive head.

In a preferred embodiment, the wheel farthest from the tubing orifice along the conveyor path is the single drive wheel. However, in an alternative embodiment, the drive head may contain a second drive wheel located closest to the orifice along the conveyor path. Also in the preferred embodiment, the drive head wheels are aligned in a vertical manner to minimize the size of the drive head.

According to another aspect of the invention, the drive head wheels are comprised of hubs on which are mounted tires. This design allows the tires to be rotated and replaced as they are subjected to wear during the operation of the drive head apparatus. This feature cuts down on maintenance and reduces operating costs as the need for replacing the entire wheel is avoided. In the preferred embodiment, these wheels have identically formed hubs for ease of manufacture, but the tires have different outer perimeter geometries and compositions depending on which wheel hub the tire is to be mounted. Fasteners such as face plates are provided to secure the tires in place. The provision of separate tires also allows the gripping surface or conveyor track to be made of a different material than the wheel hub, such as polyurethane where the wheel hub is polyvinyl chloride or other suitable materials.

The drive head of the present invention provides an efficient and dependable mechanism for driving a conveyor along a predetermined conveyor path. The present invention maximizes the contact of the conveyor with the drive wheel, prevents the exit side tension of the conveyor from ever going to zero when the apparatus is running, does not require pinching of the conveyor to provide traction, and is less susceptible to the hydroplaning of the conveyor in the case where liquids are transported. Further, under normal working load conditions (as measured by conveyor tension), this new apparatus exhibits conveyor longevities that are from two to ten times those previously achievable.

The drive head can be used as part of a lightweight and inexpensive system which effectively replaces the expensive well production apparatus currently available to industry. The drive head of the invention may be constructed for many thousands of dollars less than the cost of a sucker rod pump. The drive head apparatus is many times smaller and lighter than a standard sucker rod pump, yet can produce oil at comparable flow rates and with equal or less power consumption. Additionally, it is easy to install and service, as no heavy well servicing vehicle and rig (see FIG. 1) is required to access the down-hole portion of the pump. Rather, the drive head apparatus and conveyor system may be installed with a minimum of effort using a pick-up truck loaded with a spool of flexible tubing for feeding down the well shaft.

Additional features and advantages of the invention will be apparent in the written description which follows.

DETAILED DESCRIPTION OF THE INVENTION

Figure 1:
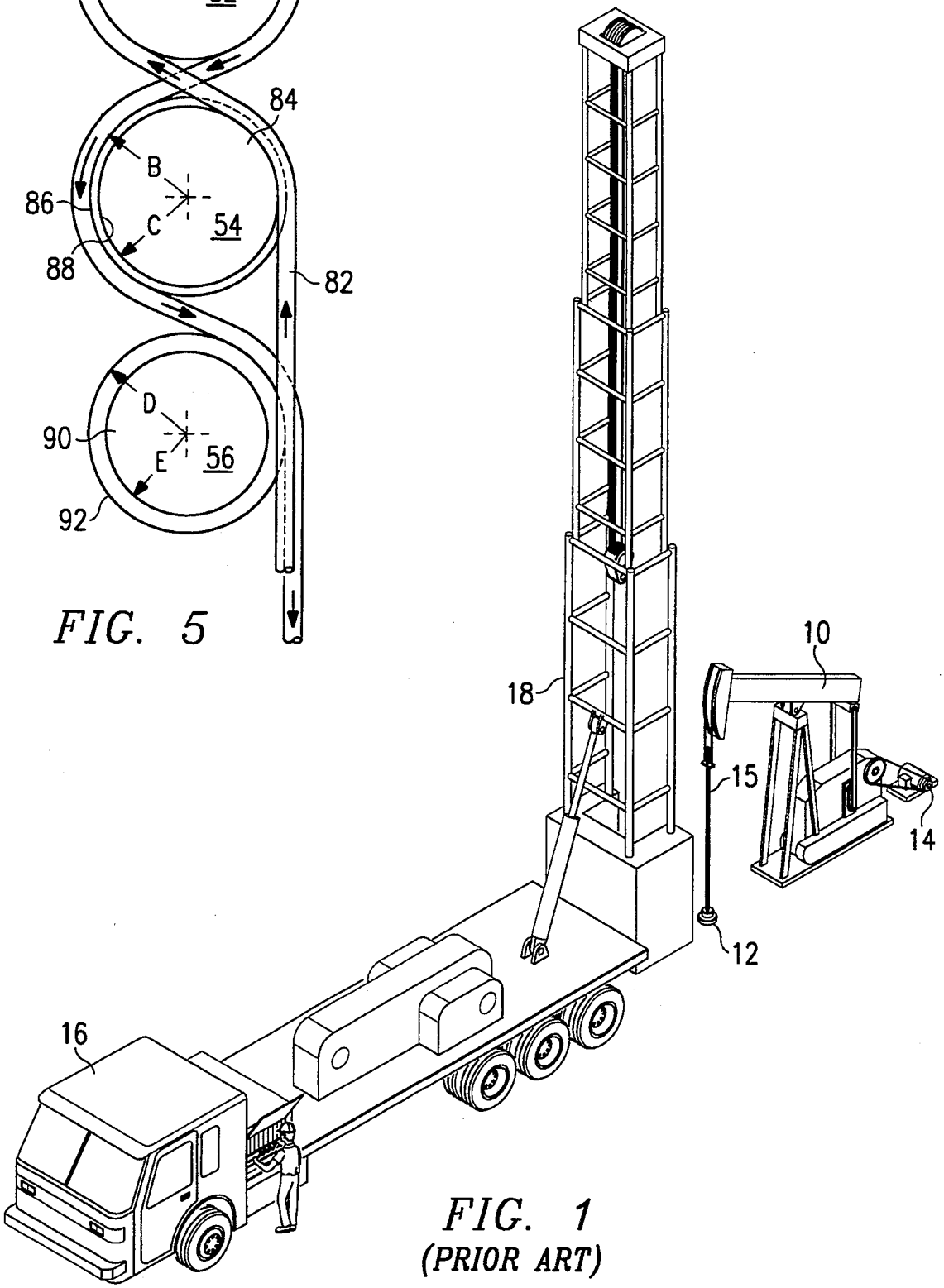
FIG. 1 (PRIOR ART)
FIG. 1 is an isometric view of the prior art showing a sucker rod pump, fuel servicing rig and derrick.

Referring to FIG. 1, there is a general illustration of the current practice for obtaining oil from low production, "stripper" wells. A sucker rod pump 10 is mounted above a stripper well 12. The sucker rod pump 10 is driven by an electric motor 14 of a fairly large size. The pump 10 actuates a sucker rod assembly 15 in a conventional reciprocating motion, pumping the oil from the well 12. Also shown is a well servicing rig 16 which is necessary to install and service the typically steel tubing and rod string and downhole production apparatus. The well servicing rig 16 erects a relatively massive derrick 18 above the stripper well 12 to lift the large weight of the steel tubing string (typically on the order of 350,000 lbs.).

Figure 2:
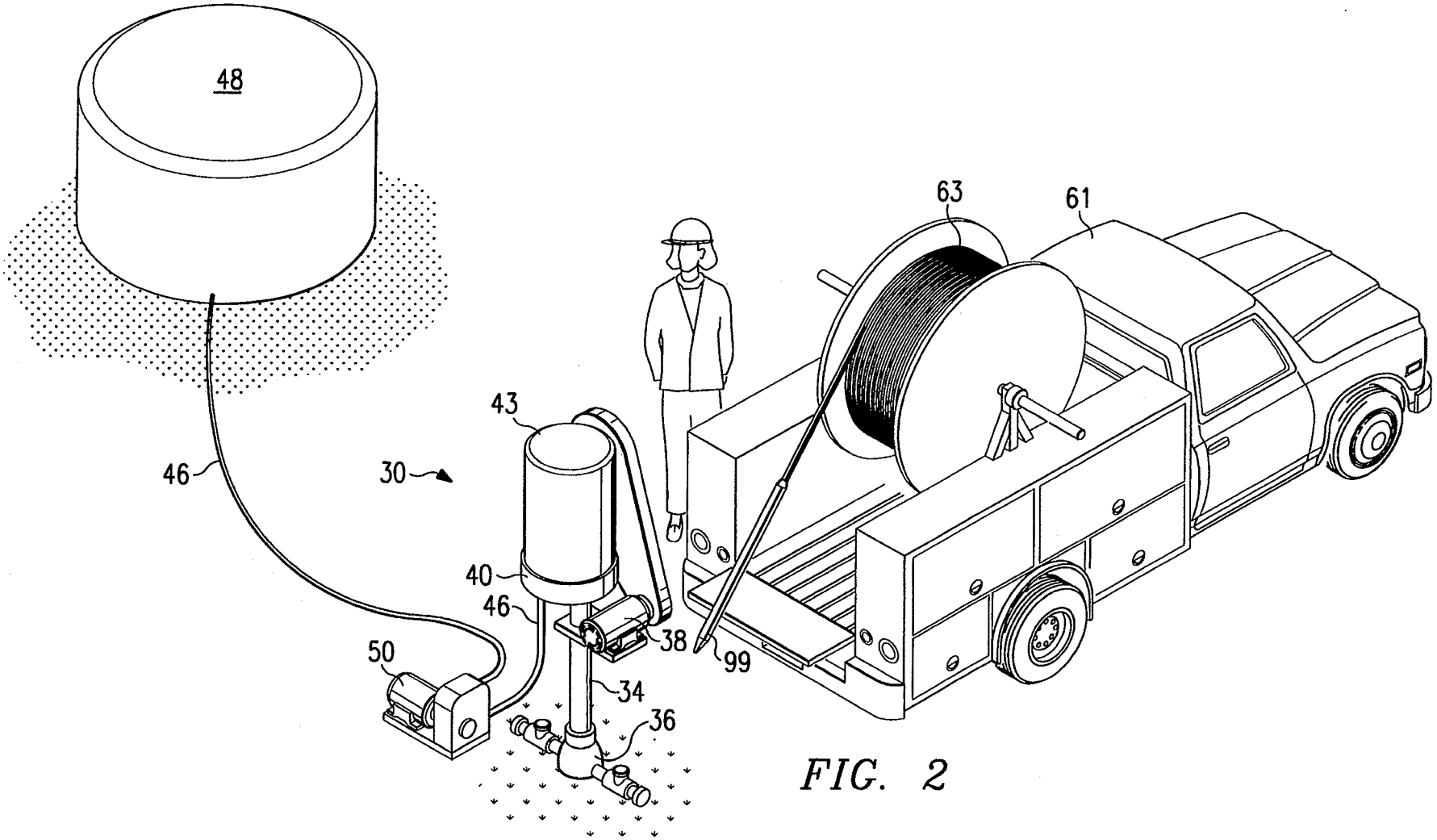
FIG. 2 is an isometric view of a production system using the present invention showing the drive head, an electric motor as prime mover, a pickup truck with a spool of tubing for servicing the system, and an external oil storage tank.

Turning to FIG. 2, there is illustrated a preferred embodiment of a drive head, generally designated at 30, for transporting oil, water or other fluids in accordance with the present invention. The drive head 30 includes a collecting pan 40 which is mounted on a standpipe 34. The standpipe 34 is mounted on an above-surface protrusion of an oil well head or orifice 36. To the standpipe 34 is mounted a prime mover 38, such as an electric motor 38 for driving the drive head apparatus 30. Other prime movers can be used in place of the electric motor 38, such as internal combustion engines or hydraulic apparatus, and these may be mounted elsewhere than on the standpipe 34, such as on a concrete pad (not shown) in proximity to the well head 36. The collecting pan 40 collects the oil (or other produced fluid) brought to the surface by the drive head apparatus 30. A cover 43 fits over the drive head 30. At the bottom of the collecting pan 40 is a hole (see FIG. 3) to which is fitted a pipe 46 to carry the oil or other produced fluid from the drive head 30 to a collection tank 48, as by means of a standard electric pump 50.

A relatively small pickup truck 61 is shown for servicing the drive head apparatus 30 and associated tubing string. The truck 61 is large enough to carry a spool of flexible tubing 63 used with the invention, which has a pulley assembly 64 at a remote or downhole tubing end 65. For a more complete description of a conveyor and flexible tubing string advantageously used with the invention, reference is made to U.S. Pat. No. 5,048,670, which is fully incorporated by reference herein.

Figure 3:
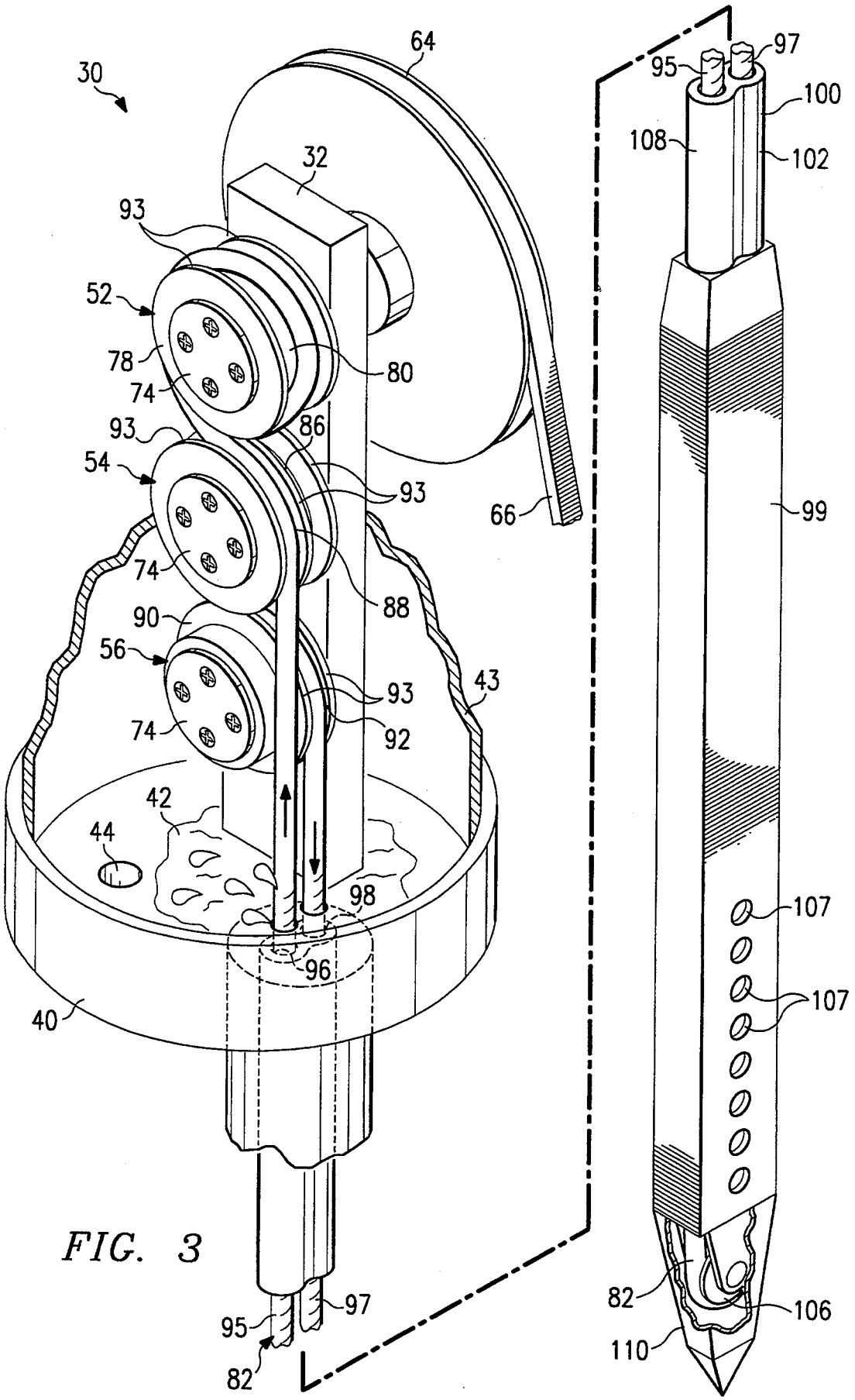
FIG. 3 is an isometric view of a drive head and production system according to the present invention, with a drive head cover, belt guard and tail pulley cover being broken away to view internal components.

FIG. 3 is a more detailed view of the fluid production system of the present invention with the cover 43 of the drive head 30 broken away to show the interior detail of the drive head 30. The drive head 30 includes rigid frame 32 on which is mounted a first or drive wheel 52, a second wheel 54 and a third wheel 56. In the illustrated embodiment, wheels 52–56 are mounted in a vertical line with wheel 52 being positioned on top and wheel 56 on the bottom, and closer to the well orifice. Each of the wheels 52–56 is rotatably mounted on frame 32 by means of a shaft and roller bearings (see FIG. 4) or bushings.

In the illustrated embodiment, the shaft of drive wheel 52 extends through frame 32 to a pulley or belt wheel 64, which is connected by belt or band 66 to the electric motor 38 (FIG. 2). In FIG. 3, the belt guard is not shown for purposes of clarity. In an alternative embodiment, the shaft of drive wheel 52 could be the same as the shaft of an electric motor or turbine mounted directly thereon.

Figure 4:
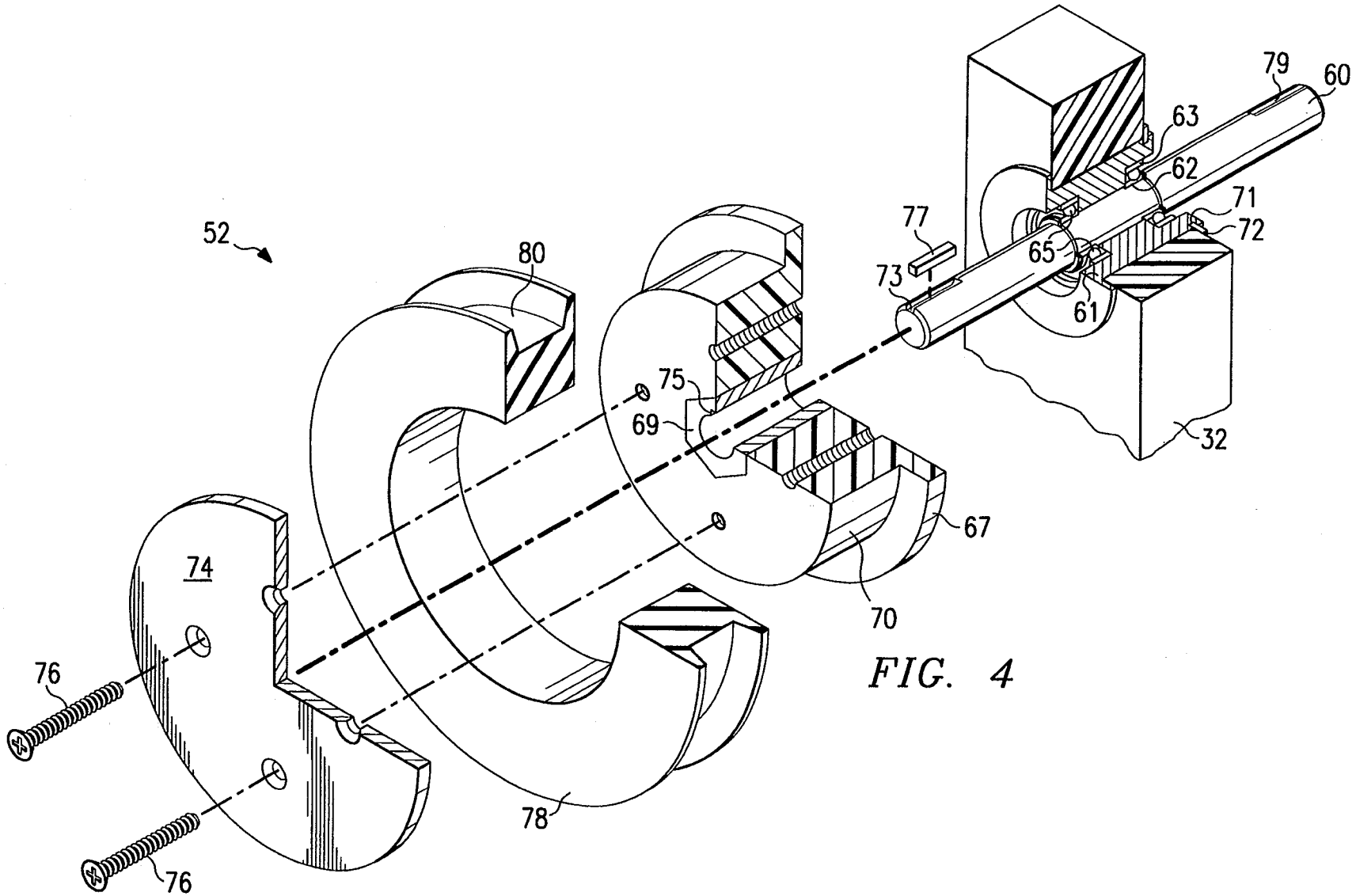
FIG. 4 is a partial sectional, exploded isometric view of a wheel, shaft and bearing assembly according to the invention.

FIG. 4 is an exploded isometric view of drive wheel 52 and associated structure. Wheel 52 preferably is constructed of a hub 70 and a tire 78. The two-part construction allows the materials forming hub 70 and tire 78 to be different. For example, hub 70 may be formed of a relatively hard plastic such as polyvinylchloride or ABS or other materials while tire 78 may be formed of a material giving gripping surface or conveyor track 80 a high coefficient of friction. The two-part construction also permits the drive tire 78 to be reversed, evening out the wear of surface 80, and/or replaced without replacing hub 70. A flange 67 of hub 70 acts as a physical stop for tire 78.

The hub 70 is mounted on a shaft 60. Shaft 60 is received into a bearing block 61 having front and back bearing races 62 and 63, in which ball bearings 65 are disposed. The bearing block 61 is press-fit into frame 32. Bearing block 61 is secured to frame 32 as by means of a groove 71 and a circumferential retaining ring 72. Alternatively, bushings may be substituted for bearings 65 and bearing block 61.

The hub 70 has a sleeve 69 which has a noncircular exterior surface (such as hexagonal) and an interior circular cylindrical surface for receiving the shaft 60. Shaft 60 and sleeve 69 have respective key ways 73 and 75 for receiving a key 77, which rotationally locks the shaft 60 to the wheel hub 70. A similar key way 79 is provided on the opposite end of the shaft 60 for mounting belt wheel or pulley 64 (see FIG. 3).

Shaft 60, bearing block 61, bearings 65, sleeve 75 and key 77 are preferably fabricated of stainless steel or another machinable material which resists corrosion from the produced fluid.

Tire 78 is mounted on hub 70 by means of a fastener such as a face plate 74. Face plate 74 is affixed to hub 70 as by means of screws 76. The tire-and-hub construction illustrated in FIG. 4 is also preferred because it allows a fabricator to manufacture each of three identical hubs 70, and only vary the outer profile of the tire mounted on the hub. As will be explained in conjunction with FIGS. 3 and 5, each of the three tires used in the preferred embodiment is shaped differently from the other. The interior diameter of tire 78 is chosen such that it grips hub 70 tightly, but not so tightly that the gripping surface arches away from the cylindrical surface of hub 70.

Figure 5:
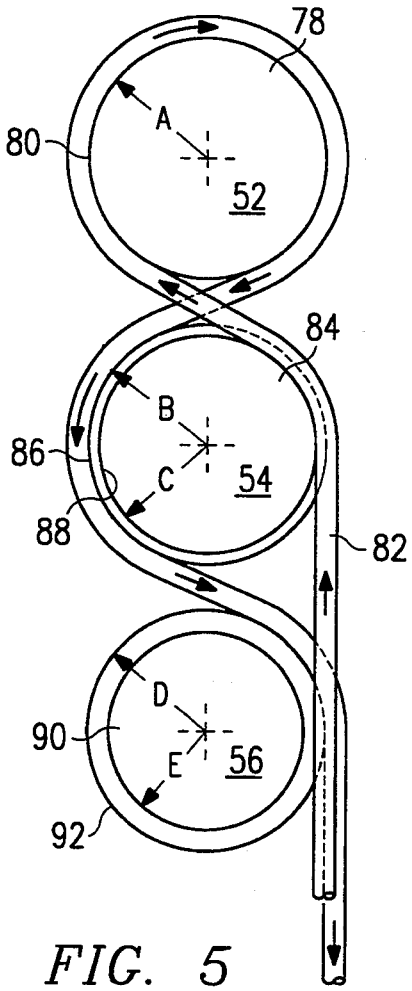
FIG. 5 is a schematic front elevational view of the drive head wheels and conveyor path according to a preferred embodiment of the invention.

The preferred conveyor path in the drive head 30 is best shown in FIG. 5 which is a schematic representation of how the three wheels 52–56 in drive head 30 help define a conveyor path for conveyor 82. The tire 78 for the drive wheel 52 possesses a single conveyor track 80 adaptable to receive the fluid-entraining conveyor 82. The radius A of the tire along the surface of the conveyor track 80 for the drive wheel tire 78 can be chosen as 5.5 inches; the recited dimensions will vary according to the rotational speed of shaft 60 (FIG. 4) and the desired velocity of conveyor 82. A tire 84 for the second wheel 54 possesses an inner conveyor track 86 and an outer conveyor track 88. The radius B of the tire 84 for the second wheel 56 along the surface of the inner conveyor track 86 is intentionally chosen to be slightly larger than track radius A, and in the illustrated embodiment is 5.55 inches. Generally, the ratio of radius B to radius A should be in the range of 1.005 to 1.07, depending on elasticity of the conveyor and the tensile force applied to it. The radius C of the tire along the surface of the outer conveyor track 88 may be the same as radius A.

The tire 90 for the third wheel 56 preferably possesses only an inner conveyor track 92. The radius D of the tire 90 for the third wheel 56 along the surface of the inner conveyor track 92 is 5.50 inches; a general radius E extending outward from conveyor track 92 is substantially reduced, such that it will not contact conveyor 82. In the illustrated embodiment, the general radius E is 5.0 inches.

Radius B is intentionally chosen to be slightly larger than radius A such that the conveyor 82 will be tightly cinched onto the drive wheel 52. In conjunction with the weight and/or tension of the down-conveyor portion of the conveyor 82 experienced by wheels 54 and 56, wheel 54 will act to take out any slack from the conveyor 82 as it passes around the drive wheel 52, thereby militating against hydroplaning. As is best shown in FIG. 3, each of the conveyor tracks 80, 86, 88 and 92 are provided with suitable beveled flanges 93 that are deep enough to retain the conveyor 82. The width of the gripping surface or conveyor track 80 is such that conveyor 82 can be received from the outer conveyor track 88 of second wheel 54, yet be aligned for reception by inner conveyor track 86 of second wheel 54 after it has passed around drive wheel 52.

Viewing FIGS. 3 and 5 together, it can be seen that the up-conveyor portion 95 of conveyor 82 enters the drive head 30 through an entrance hole 96 in the collecting pan 40, which preferably is sealed to the top end or orifice of a flexible tubing string 102.

Conveyor 82 follows a conveyor path which is partially defined by portions of tracks 88, 80, 86 and 92 as follows. The up-conveyor or entrance portion 95 of conveyor 82 passes by the third wheel 56 without coming into contact with it because of tire 90's reduced radius exterior to track 92. The conveyor 82 then passes over the outer track 88 on the second wheel 54 in a counter-clockwise direction through an angle of approximately sixty degrees. The conveyor 82 leaves the second wheel 54 at an upward angle, and comes into contact with the conveyor track 80 of the drive wheel 52. The conveyor 82 passes over the conveyor track 80 in a clockwise direction, and stays in contact with the conveyor track 80 over at least a majority of its surface, and preferably extending through an angle of about 330 degrees. The more the gripping surface 80 can be engaged to conveyor 82, the more tractive force will be available. Wheel 54 is positioned sufficiently closely to wheel 52 that the amount of engaged gripping surface on track 80 is optimized. At this point, conveyor 82 leaves the drive wheel conveyor track 80 and begins, as a down-conveyor or exit portion 97, the return path towards the bottom of the collecting pan 40.

The conveyor 82 returns to the second wheel 54, where it now comes into contact with the inner track 86 thereof, which is preferably distinct from the outer track 88. The conveyor 82 passes over the inner track 86 in counter-clockwise direction through an angle of at least 120 degrees. Because of inner conveyor track 86's slightly increased radius with respect to the radius of drive conveyor track 80, the wheel 54 will act to tightly cinch the conveyor 82 to the drive wheel 52, improving traction. The force of gravity (in installations in which the exit portion 97 of the conveyor is below the drive head 30) and/or exit tension of the down-conveyor portion 97 aids in this cinching function. The conveyor 82 next passes to the single conveyor track 92 of the third wheel 56, travelling over this track 92 in a clockwise direction through an angle of approximately 60 degrees. The conveyor 82 then exits through an exit hole 98 in the bottom of the collecting pan 40.

Once the conveyor 82 passes through the exit hole 98 it travels down a down side 100 of a tubing string 102. Tubing string 102 is preferably divided into separate passageways 100 and 108. At a sufficient depth to come in contact with the oil or other produced fluid 42, the conveyor 82 enters a termination or tail assembly 99 and travels around a tail or remote pulley 106, which is covered by a cover 110, here shown broken away. Oil (or other produced fluid, such as water) enters holes 107 in the assembly 99. The conveyor 82 then travels through the termination assembly 99 and up an up side 108 of the tubing string 102, returning to the drive head apparatus 30 along with a quantity of the produced fluid. In an alternative embodiment, downtube or downside 100 may be perforated along a lower portion of its length to permit the ingress of the fluid. In this instance, tail assembly 99 may or may not be perforated.

Figure 6:
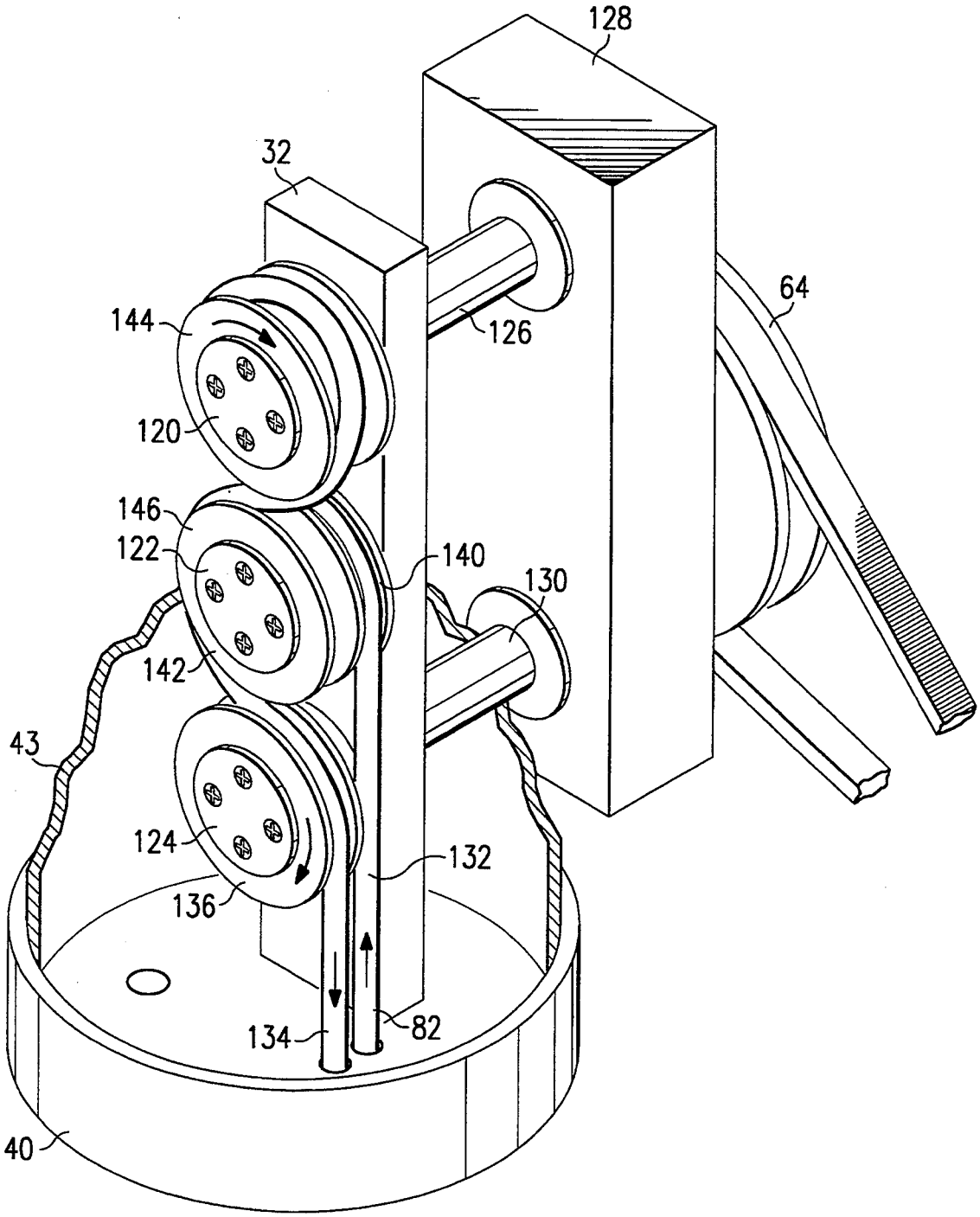
FIG. 6 is an isometric view of a system for transporting oil using an alternative embodiment of the present invention showing two drive wheels and an alternative conveyor path.

FIG. 6 illustrates a second embodiment of the invention. Like characters identify like parts where possible. In this embodiment, the frame 32 has mounted on it a top drive wheel 120, a second or middle idler wheel 122 having two tracks, and a bottom or third wheel 124, which in this embodiment is also a drive wheel. A shaft 126 extends from the top drive wheel to a drive box 128. A shaft 130 has mounted on it the third or bottom wheel 124 and likewise extends to the drive box 128. Suitable gearing (not shown) imparts rotational force to both shafts 126 and 130, and these shafts may be made to rotate at the same or slightly different speeds. A limited slip differential may also be employed to vary the speed of shaft 130 as a function of the amount of slip experienced in conjunction with shaft 126, so as to keep the production conveyor 82 under a steady force to minimize abrasion.

In addition to illustrating the possibility of multiple drive shafts, FIG. 6 also illustrates an embodiment wherein the up-conveyor section 132 of conveyor 82 proceeds upwardly on a path which is closest to the frame 32, and a down-conveyor section 134 of conveyor 82 which takes a path that is disposed axially outwardly from up-conveyor section 132. According to this embodiment, the radius of the lower drive wheel tire 136 on its axially interior portion is sufficiently reduced that no contact is made with up-conveyor 132. Instead, up-conveyor 132 passes directly to an inner track 140 of the second, idler wheel tire 142. The conveyor then passes to the conveyor track of the upper drive wheel tire 144. From the drive tire 144, the conveyor proceeds to a second, exterior track 146 of the idler tire 142, which is preferably of slightly increased radius in comparison with the radius of the upper drive tire 144. The production conveyor 82 then passes to the lower drive wheel 124 and engages the single exterior track of the lower tire 136. It then proceeds down hole.

As the length of the well from which the fluid is being produced increases, it may be necessary to add further idler wheels or drive wheels in order to provide sufficient traction on the production conveyor 82.

While the present invention has been illustrated mainly in conjunction with a "stripper" oil well, it is useful for any fluid production system by which fluid is to be transported a long distance using a conveyor. For example, the present invention finds utility in producing water from water wells. The present invention also has utility in a system in which a flexible tubing string is other than in a straight line or which is disposed other than vertically; as described in U.S. Pat. No. 5,048,670, a conveyor may use the principles of Couette flow theory to entrain therewith a quantity of fluid along with the conveyor, and the fluid acts to support, displace or offset the conveyor from the sides of the tubing. The drive head of the invention described in this application may therefore have application in any conveyor configuration wherein a large amount of traction needs to be exerted on the conveyor 82.

Suitable changes or modifications may also be made in the drive head where the conveyor 82 is not cylindrical in section. Where the conveyor 82 takes the form of a relatively flat belt or band, the widths of the conveyor tracks 80, 86, 88 and 92, and the depths of flanges 93, would be appropriately modified.

In summary, a novel drive head configuration for a conveyor has been shown and described. First, second and preferably third drive head wheels are arranged such that the conveyor is continuously cinched against the conveyor track of the drive wheel, thereby militating against hydroplaning and problems resulting from the loss of exit conveyor tension. The present invention further employs changeable tires as the tracks or gripping surfaces for the conveyor.

While preferred embodiments of the present invention have been illustrated and described in the above detailed description, the present invention in not limited thereto but by the scope and spirit of the appended claims.

What is claimed is:

1. A drive head for use in transporting fluids using a conveyor, comprising:

a frame for mounting near a tubing orifice;

a drive wheel and a second wheel rotatably mounted on said frame and each adaptable to receive a fluid-entraining conveyor;

a first conveyor track of said drive wheel with a first radius and adaptable to contact said conveyor through at least the majority of the circumference of said conveyor track;

a second conveyor track formed on said second wheel and having a second radius larger than said first radius, portions of said first and second conveyor tracks defining respective portions of a conveyor path extending from said tubing orifice through said drive head and back into said tubing orifice, said second conveyor track being nearer to said orifice on said conveyor path than said first conveyor track; and a prime mover coupled to said drive wheel for imparting a rotational force thereto.

2. The drive head of claim 1, wherein said second wheel receives said conveyor from the tubing orifice.

3. The drive head of claim 2, wherein said second wheel includes a third conveyor track distinct from said second conveyor track, said second wheel receiving said conveyor from said tubing orifice on said third track.

4. The drive head of claim 2, wherein said third conveyor track is disposed axially outwardly from said second track on said second wheel with respect to said frame.

5. The drive head of claim 2, wherein said third conveyor track is disposed axially inwardly from said second track on said second wheel with respect to said frame.

6. The drive head of claim 1, wherein said second conveyor track on said second wheel is positioned sufficiently close to said first track on said drive wheel that said conveyor path includes about 330 degrees of the circumference of said first conveyor track.

7. The drive head of claim 1, and further including a third wheel of said drive head rotatably mounted on said frame and disposed on said conveyor path to be closer to said tubing string orifice than said drive wheel.

8. The drive head of claim 7, wherein said conveyor path has an entrance portion prior to said first conveyor track and an exit portion subsequent to said first conveyor track, said third wheel having a fourth conveyor track which comprises a section of said exit portion only.

9. The drive head of claim 7, wherein said drive wheel, said second wheel and said third wheel are in linear alignment.

10. The drive head of claim 1, wherein said conveyor is selected from the group consisting of rope, string, cables, filaments, bands, belts and strands.

11. The drive head of claim 1, wherein the ratio of said second radius to said first radius falls within the range of 1.005 to 1.07.

12. A system for transporting fluids, comprising:

a drive head with a frame for mounting near a tubing string orifice;

a drive wheel and a second wheel rotatably mounted on said frame and each adaptable to receive an endless fluid-entraining conveyor, said conveyor following a conveyor path adjoining said first and second wheels and extending into and out from said tubing string orifice, said second wheel being nearer said orifice on said conveyor path than said drive wheel;

a first conveyor track of said drive wheel having a first radius and adaptable to contact said conveyor through at least a majority of the circumference of said first conveyor track;

a second conveyor track formed on said second wheel and having a second radius larger than said first radius;

a prime mover coupled to said drive wheel for imparting a rotational force thereto; and a remote pulley located at an end of said tubing string opposite said orifice, said conveyor passing around said remote pulley.

13. The drive head of claim 12, wherein said second wheel receives said conveyor from the tubing string orifice.

14. The drive head of claim 13, wherein said second wheel includes a third conveyor track distinct from said second conveyor track, said second wheel receiving said conveyor from said tubing string orifice on said third track.

15. The system of claim 12, wherein said third track is spaced axially outwardly from said second track on said second wheel with respect to said frame.

16. The system of claim 12, wherein said third track is spaced axially inwardly from said second track on said second wheel with respect to said frame.

17. The system of claim 12, wherein said second conveyor track on said second wheel is positioned sufficiently close to said first track on said drive wheel that said conveyor path includes at least 330 degrees of the circumference of said first conveyor track.

18. The system of claim 12, and further including a third wheel disposed nearer said orifice on said conveyor path than said second wheel.

19. The system of claim 18, wherein said conveyor has an entrance portion prior to engagement with said first conveyor track and an exit portion subsequent to engagement with said first conveyor track, said third wheel engaging only said exit portion.

20. The system of claim 18, wherein said drive wheel, said second wheel and said third wheel are in linear alignment.

21. The system of claim 12, wherein said conveyor has an entrance portion prior to engagement with said first track on said first wheel and an exit portion subsequent to engagement with said first track on said first wheel, gravitational force applied on said exit portion of said conveyor aiding said second wheel to cinch the conveyor against the first conveyor track of the first wheel.

22. The system of claim 12, wherein said conveyor includes an entrance portion proceeding toward said drive head and an exit portion proceeding away from said drive head, said tubing string orifice including separate passageways for receiving said entrance and exit portions.

23. The system of claim 12, wherein said conveyor is selected from the group consisting of rope, cables, strings, bands, strands, filaments and belts.

24. The system of claim 12, wherein said orifice is a well head.

25. A system for transporting fluids, comprising:

a drive head with a frame for mounting near a well head;

a drive wheel and a second wheel rotatably mounted on said frame and each adaptable to receive an endless fluid-entraining conveyor, said conveyor following a conveyor path adjoining said first and second wheels and extending to and from said well head, said second wheel being nearer said well head on said conveyor path than said drive wheel;

a first conveyor track of said drive wheel having a first radius and adaptable to contact said conveyor through at least a majority of the circumference of said first conveyor track;

a second conveyor track on said second wheel with a second radius larger than said first radius;

a prime mover coupled to said drive wheel for imparting a rotational force thereto; and a downhole pulley located in said well at a predetermined distance from said well head, said conveyor passing around said downhole pulley.

26. A method for transporting materials, comprising the steps of:

passing a continuous conveyor through a conveyor path that leads from an orifice of a tube and into a drive head;

passing said conveyor around a portion of a third conveyor track disposed on a second wheel mounted on a frame of the drive head;

passing said conveyor from said third conveyor track to a first conveyor track formed on a drive wheel mounted on said frame;

passing said conveyor around at least a majority of the circumference of said first conveyor track;

passing said conveyor from said first conveyor track to a second conveyor track formed on the second drive wheel;

passing said conveyor from said second conveyor track to a fourth conveyor track formed on a third wheel mounted on said frame;

passing said conveyor from said fourth track into said orifice;

passing said conveyor over a pulley located at a remote end of said tubing string;

returning said conveyor from said pulley to said orifice and into said drive head apparatus to complete said conveyor path of said conveyor; and rotating said drive wheel to cause said conveyor to move along said conveyor path, thereby causing material to be transported along said tube toward said orifice.

27. The method of claim 26, and further comprising the step of choosing the radius of said second conveyor track to be larger than the radius of said first conveyor track.

28. A drive head for use in transporting materials, comprising:

a frame for mounting near a tubing orifice;

a drive wheel, a second wheel, and a third wheel rotatably mounted on said frame and each adaptable to receive a fluid-entraining conveyor, said conveyor following a conveyor path adjoining said drive, second, and third wheels and extending to and from said tubing orifice, said second wheel being nearer said orifice on said conveyor path than said drive wheel, said third wheel being nearer said orifice on said conveyor path than said second wheel;

said drive wheel having a first conveyor track with a first radius adaptable to receive a conveyor on said conveyor path such that said conveyor winds about at least a majority of the circumference of said first track;

said second wheel having a second conveyor track with a second radius larger than said first radius and a third conveyor track distinct from said second conveyor track;

said conveyor following said conveyor path such that said conveyor comes into contact with said third conveyor track on said second wheel as said conveyor follows said conveyor path away from said orifice and said conveyor comes into contact with said second track on said second wheel after said conveyor comes into contact with said drive wheel and as said conveyor follows said conveyor path towards said orifice; and a prime mover coupled to said drive wheel for imparting a rotational force thereto.

29. The drive head of claim 28, and further comprising a third wheel rotatably mounted on said frame and disposed adjacent said conveyor path, said third wheel being closer to said orifice on said conveyor path than said third track on said second wheel.

30. The drive head of claim 29, wherein said third wheel includes a fourth conveyor track which receives said conveyor only on an exit side of said conveyor path.

31. The drive head of claim 28, wherein said second track on said second wheel is disposed axially interiorly of said third track on said second wheel with respect to said frame.

32. The drive head of claim 28, wherein said second track on said second wheel is disposed axially exteriorly of said third track on said second wheel with respect to said frame.

33. The drive head of claim 28, wherein the radius of said second track is greater than the radius of said third track.

34. The drive head of claim 28, wherein the radius of second conveyor track is greater than the radius of said first conveyor track.

35. The drive head of claim 28, wherein said second wheel is disposed sufficiently close to said first wheel such that at least 330 degrees of the circumference of said first conveyor track forms a portion of said conveyor path.

36. A drive head for use in transporting fluids, comprising:

a frame for mounting near a well head;

a drive wheel rotatably mounted on said frame, said drive wheel including:

a wheel hub formed of a first, relatively hard material; and a drive tire having a gripping surface for a fluid-transporting conveyor, said tire formed of a second material which exhibits a higher coefficient of friction with respect to said conveyor than said first material of said wheel hub and mounted on said wheel hub.

37. The drive head of claim 36, and further comprising a second wheel rotatably mounted on said frame, a conveyor path defined from said well head to said drive head and back to said well head, said conveyor path passing adjacent said second wheel and said drive wheel, said second wheel including a second wheel hub, a second tire having a gripping surface for said fluid-transporting conveyor mounted on said second wheel hub.

38. The drive head of claim 37, wherein said wheel hubs of said first and second wheels are similar, said drive tire and said second tire having different radially outward profiles.

39. The drive head of claim 37, wherein said second tire has two distinct conveyor tracks.

40. The drive head of claim 37, wherein said gripping surface of said drive tire includes a first conveyor track, the radius of one of the conveyor tracks on said second tire being greater than the radius of the first conveyor track on the drive tire.

41. The drive head of claim 37, wherein the radius of one of the conveyor tracks on the second tire is greater than the radius of the other of the conveyor tracks on the second tire.

42. The drive head of claim 37, and further comprising a third wheel rotatably mounted on said frame and adjacent to said conveyor path, said third wheel mounted to be closer to said tubing on said conveyor path orifice than said second wheel, a third tire having a gripping surface for said fluid transporting conveyor being mounted on said third wheel.

43. The drive head of claim 36, wherein said wheel hub is made of a hard plastic, said tire being made of an elastomer which has a higher coefficient of friction with respect to said conveyor than said hard plastic.

44. The drive head of claim 43, wherein said hard plastic is selected from the group consisting of polyvinyl chloride and ABS, said elastomer forming said tire being polyurethane.

45. The drive head of claim 36, and further comprising a fastener for releasably securing said tire to said wheel hub.

46. The drive head of claim 45, wherein said fastener is a face plate mounted to said wheel hub so as to hold said tire on said wheel hub.

47. A drive head for use in transporting fluid materials, comprising:

a frame for mounting near a tubing orifice;

a drive wheel, a second wheel, and a third wheel rotatably mounted on said frame and each adaptable to receive, in sequence, a fluid-entraining conveyor, said conveyor following a conveyor path adjoining said drive wheel, said second wheel, and said third wheel, and extending from and back to said tubing orifice, said second wheel being nearer said orifice on said conveyor path than said drive wheel, said third wheel being nearer said orifice on said conveyor path than said second wheel;

said drive wheel having a first conveyor track with a first radius such that said conveyor winds about said drive wheel through at least a majority of the circumference of said conveyor;

said second wheel having an interior conveyor track with a first radius and an exterior conveyor track with a second radius, said second radius being larger than said first radius;

said third wheel having an interior conveyor track with a third radius and an exterior conveyor track with a fourth radius, said fourth radius sufficiently small to not come into contact with said conveyor;

said conveyor following said conveyor path such that said conveyor comes into contact with said exterior conveyor track of said second wheel as said conveyor follows said conveyor path away from said orifice and said conveyor comes into contact with said interior conveyor track of said second wheel after said conveyor comes into contact with said drive wheel and as said conveyor follows said conveyor path towards said orifice, and such that said conveyor lastly comes into contact with said interior conveyor track of said third wheel as said conveyor follows said conveyor path and proceeds toward said orifice; and means for imparting a rotational force to said drive wheel.

* * * * *